United States Patent [19]

Fischer

[11] 4,313,504

[45] Feb. 2, 1982

[54] TANDEM RIPPER ASSEMBLY

[75] Inventor: Robert L. Fischer, New Lenox, Ill.

[73] Assignee: Caterpillar Tractor Co., Peoria, Ill.

[21] Appl. No.: 102,198

[22] Filed: Aug. 13, 1979

[51] Int. Cl.[3] ..... A01B 63/118; A01B 13/08; E02F 5/30

[52] U.S. Cl. ..... 172/382; 172/483; 172/489; 172/699; 172/473

[58] Field of Search ..... 172/40, 328, 382, 396, 172/196, 483, 484, 464, 488, 489, 699, 195, 293, 473, 700

[56] References Cited

U.S. PATENT DOCUMENTS

| | | | |
|---|---|---|---|
| 905,895 | 12/1908 | Luchini | 172/382 |
| 1,033,245 | 7/1912 | Huggins | 172/699 |
| 1,145,212 | 7/1915 | Plummer | 172/763 |
| 1,287,291 | 12/1918 | Gordon | 172/382 |
| 2,093,125 | 9/1937 | Davenport | 172/398 |
| 2,357,999 | 9/1944 | Cheek | 37/98 |
| 28558,692 | 6/1951 | Pace | 37/98 |
| 3,295,612 | 1/1967 | Mayo | 172/464 |
| 3,503,456 | 3/1970 | Larson | 172/484 |
| 3,684,030 | 8/1972 | Lucero | 172/700 |
| 4,079,593 | 3/1978 | Flippin | 172/40 |

FOREIGN PATENT DOCUMENTS

| | | | |
|---|---|---|---|
| 530685 | 10/1921 | France | 172/382 |
| 148788 | 2/1954 | Sweden | 172/196 |
| 375355 | 5/1973 | U.S.S.R. | 172/699 |
| 386096 | 9/1973 | U.S.S.R. | 172/700 |

*Primary Examiner*—Richard J. Johnson
*Attorney, Agent, or Firm*—Phillips, Moore, Weissenberger, Lempio & Majestic

[57] ABSTRACT

A ripper assembly (10) includes at least two ripper members (16,18) mounted in tandem relationship and adapted for connection to a vehicle (14). A linkage assembly (20) interconnects the ripper members. A hydraulic cylinder (44) is operable to raise and lower the linkage assembly (20) so that the leading ripper member (16) penetrates the ground first and thereafter the trailing ripper member (18) penetrates the ground, vertically below the leading ripper member. The ripper assembly insures efficient ground penetration and a self-cleaning function in comparison with conventional rippers of the multiple-tooth type.

8 Claims, 5 Drawing Figures

FIGURE 3
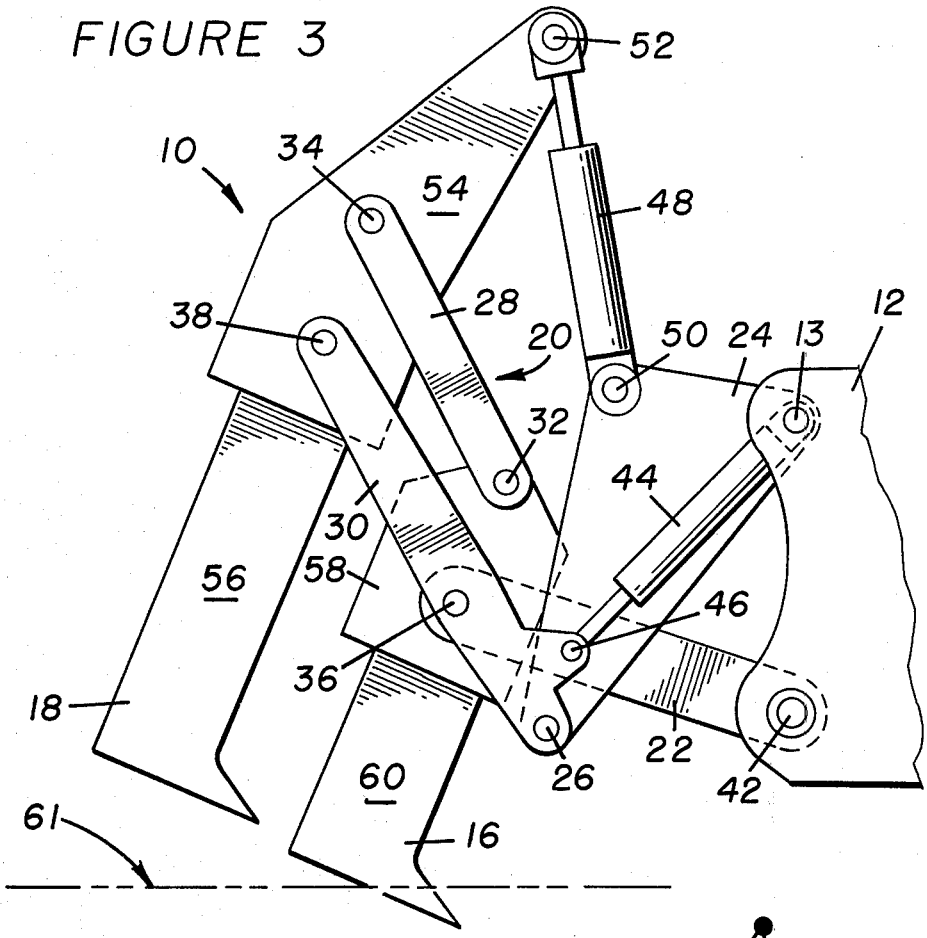
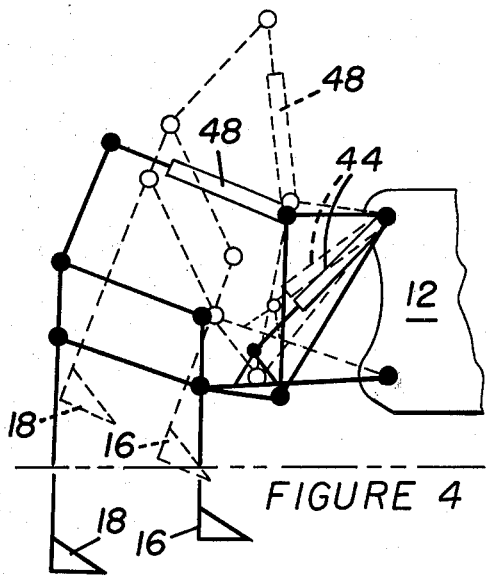
FIGURE 4
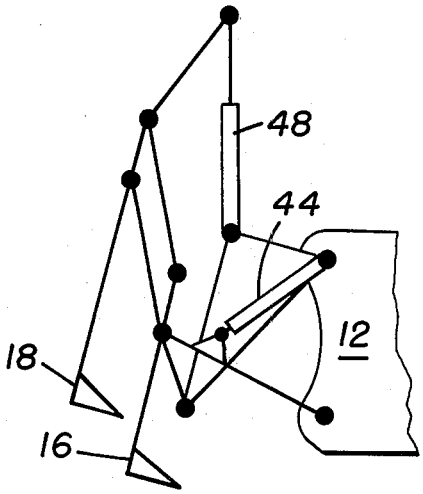
FIGURE 5

TANDEM RIPPER ASSEMBLY

TECHNICAL FIELD

This invention relates to earth working machineary. In particular it relates to a mounting arrangement for ripper teeth to be movably mounted on a vehicle.

BACKGROUND ART

In the earth working field it is quite often necessary to loosen the surface of the ground before earth removal takes place. If the terrain has not been broken before, it may be appropriate to break the earth to depths of 3 to 4 ft. or more. It has been found that the force required to pull the ripper shank and the ripper tooth through the earth is generally proportional to the square of the depth of penetration of the earth. Accordingly, to increase the ripping depth from 2 ft. to 4 ft. requires approximately four times the force for twice the depth. Of course, it is possible to work the earth twice, that is, the first pass ripping to 2 ft. while the second pass ripping from 2 ft. to 4 ft. Obvious economic considerations dictate the preference for the single pass approach to effect the 4 ft. depth out.

Mounting two ripper teeth in tandem with the trailing tooth being disposed at a greater depth than the leading tooth accomplishes the same work as a single tooth mounted at the greater depth. Furthermore, such tandem arrangement requires only approximately one-half the force to effect the 4 ft. depth cut, for example, in comparison to a single tooth arrangement maintained at the 4 ft. depth.

The broad concept of fixedly mounting two ripper teeth in tandem relationship on a vehicle may not prove effective since there would be a tendency for them to clog with earth. Thus, the cutting efficiency of the second tooth may be seriously impaired. This invention is primarily directed to the provision of the tandem ripper assembly which exhibits a high degree of cutting efficiency while yet insuring that they will not become unduly clogged during operation.

Tandem ripper teeth mounted on a rigid assembly would result in the rear-most tooth being the longest, entering the ground first as the assembly is lowered from a transport condition to an operative condition. Rather than penetrating the earth, the rear-most tooth could have a tendency to raise the rear end of the vehicle due to the relatively long moment arm extending from the center of gravity of the towing vehicle to the point of contact of the tip with the ground. On the other hand, the conventional single tooth does not have this disadvantage because it is more closely coupled to the vehicle.

DISCLOSURE OF INVENTION

The present invention is directed to overcoming one or more of the problems as set forth above.

In one aspect of this invention a ripper assembly includes a first ripper member and a second ripper member. A linkage assembly interconnects the first and second ripper members for sequentially (1) lowering the first ripper member to a vertical position below the second ripper member, and (2) lowering the second ripper member to a vertical position below the first ripper member. The assembly also includes actuators for moving the linkage assembly generally vertically. The assembly also provides for tilting the second ripper member, such tilting action imparted substantially to the same extent to the first ripper member through the linkage interconnecting the first and second ripper members.

This tandem ripper assembly provides for loosening of earth to a greater depth with less energy than with a single ripper tooth. The linkage assembly also provides differing movements of the two ripper members thereby accomplishing a self cleaning feature of the two ripper members. Finally, the assembly insures the ripper tooth closest the vehicle enters the earth first through the linkage interconnecting the two ripper members.

BRIEF DESCRIPTION OF THE DRAWINGS

FIG. 3 is a view similar to FIG. 2, but showing the ripper assembly being moved into its ground-penetrating position;

FIG. 4 is a stick diagram of the ripper assembly showing its movement from its FIG. 3 to its FIG. 2 position;

FIG. 5 is a stick diagram of the ripper assembly, showing it fully retracted to its carry position.

BEST MODE FOR CARRYING OUT THE INVENTION

Figure 1:
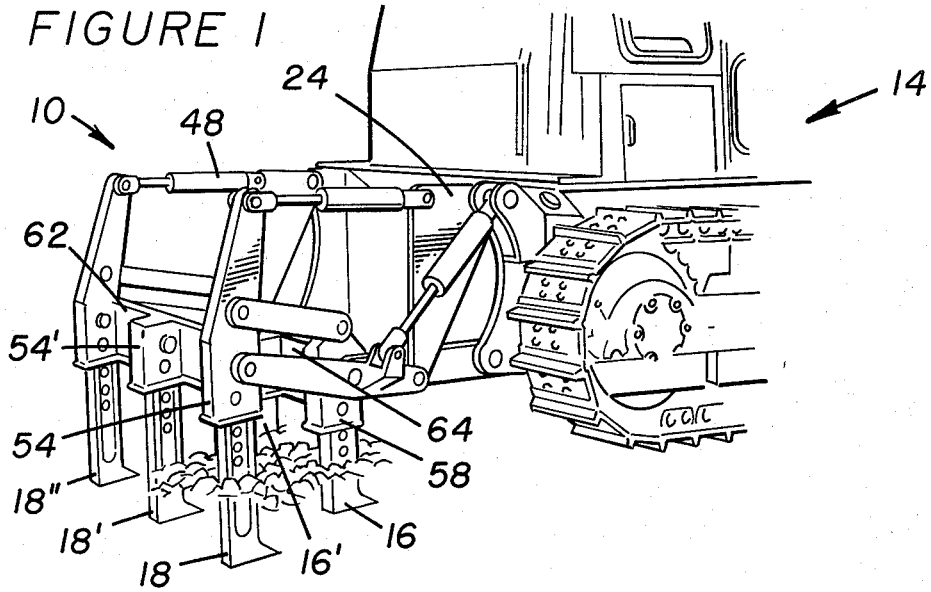
FIG. 1 is a perspective view of the tandem ripper assembly embodiment of the present invention affixed to an earth working vehicle.
Figure 2:
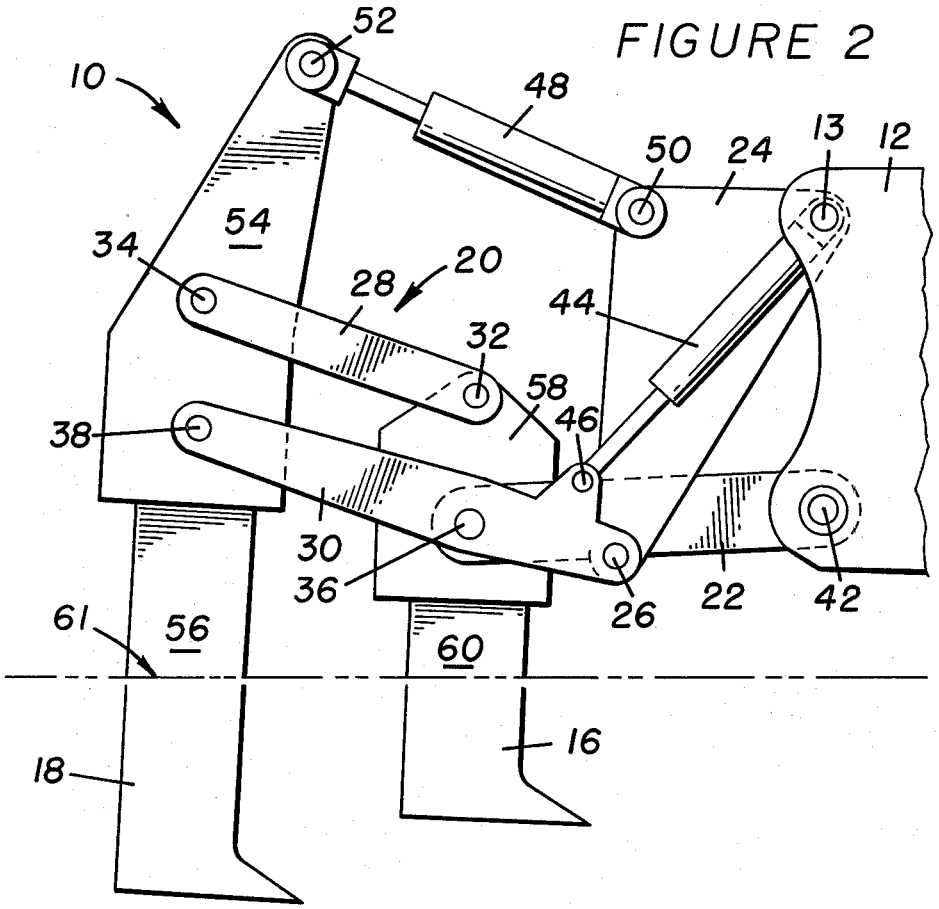
FIG. 2 is an enlarged side elevational view of the ripper assembly shown in its ground-penetrating position.

Referring to FIGS. 1 and 2, a tandem ripper assembly 10 is shown affixed to a mounting bracket 12 of a vehicle, such as a crawler tractor 14. The ripper assembly 10 includes a first ripper member 16 and a second ripper member 18. A linkage assembly 20 pivotally connects the first and second ripper members for simultaneous movement. A connecting link 22 connects first ripper member 16 to bracket 12 of crawler tractor 14. A second connecting link 24 is also adapted for connection to bracket 12 of the vehicle at one end by a pivot pin 13 and at the other end to a lever 30 of linkage assembly 20 by a pivot pin 26.

Linkage assembly 20 further comprises a link 28 pivotally interconnected between the first and second ripper member 16 and 18. Specifically, link 28 is affixed at one end by a pivot pin 32 to first ripper member 16 and at its other end by a pivot pin 34 to second ripper member 18. Lever 30 is affixed to first ripper member 16 by a pivot pin 36 and to ripper member 18 by a pivot pin 38. Pivot pin 26, which connects link 24 with the linkage assembly 20 is located on lever 30 at the end of lever 30 opposite pivot pin 38 while pivot pin 36 is positioned between pivot pin 26 and pivot pin 38. This arrangement results in relatively greater travel of ripper member 18 compared to ripper member 16 upon actuation of the means for raising and lowering linkage assembly 20.

Connecting link 24, as previously noted, is pivoted to lever 30 by pivot pin 26 at one end while the other end of this triangular shaped link is pivoted to bracket 12 by pivot pin 13. Connecting link 22, which is pivoted to ripper member 16 by pivot pin 36, is pivoted to bracket 12 by a pivot pin 42.

Means, such as a hydraulic cylinder 44, is included to act on linkage assembly 20 thereby raising and lowering first and second ripper members 16 and 18, respectively. Hydraulic cylinder 44 is pivotally affixed by pivot pin 13 to bracket 12 at the head end of the cylinder while the rod end of hydraulic cylinder 44 is affixed by a pivot pin 46 on lever 30 intermediate pivot pins 26 and 36.

A second hydraulic cylinder 48 serves to fix the parallel motion of ripper members 16 and 18 and is pivotally affixed by a pivot pin 50 to connecting link 24 and at its other end by a pivot pin 52 to second ripper member 18. Pivot pin 52 may be as indicated in FIG. 2, at the upper end of second ripper member 18.

Second ripper member 18 consists of an upper portion 54 in which the various pivots previously described are positioned, and a lower member 56 which is adapted for operating in the terrain. Lower member 56 may be adapted for vertical adjustment in upper member 54 thus varying the effective length of the ripper member.

In a similar manner, first ripper member 16 consists of an upper member 58 in which the various pivots are affixed and a lower member 60 which operates in the terrain. Both lower members 56 and 60 may be replaced with different tool members depending upon the type of work to be undertaken.

Referring now to FIG. 3, the ripper assembly 10 is shown almost completely withdrawn from the terrain 61. It should be noted that first ripper member 16 remains in the ground while ripper member 18 is completely withdrawn. The means for connecting the ripper assembly to the vehicle 14 cooperates with linkage assembly 20 to provide this result. Specifically connecting link 24 provides a first fulcrum by pivot pin 26 about which lever 30 rotates. Simultaneously connecting link 22 directly connects ripper member 16 to bracket 12 so that movement of ripper member 18 is relative to tractor 14. Finally link 28 and hydraulic cylinder 48 cooperate to transmit and amplify the motion imparted to ripper member 16 to ripper member 18. Thus when hydraulic cylinder 44 is retracted, the rotation of linkage assembly 20 about pivot pin 26 results in a greater movement to the second ripper member 18 than to the first ripper member 16.

This variable movement of the two ripper members provides two unique functions to this ripper assembly. First, the first ripper member 16 will enter the terrain 61 before the second ripper member. This is advantageous in that there is a shorter moment arm between the point of contact with the terrain 61 and the center of gravity of the crawler tractor 14. With the shorter moment arm, there is less tendency for the ripper member to "jack" or raise the vehicle. Secondly the greater movement to the second ripper member tends to unclog the ripper assembly of earth and the like upon relative movement of the two ripper members.

INDUSTRIAL APPLICABILITY

Referring again to FIG. 1, the tandem ripper assembly 10 is shown affixed to a crawler tractor 14. It should be noted that there may be a plurality of second ripper members 18, 18' and 18''. Similarly there may be a plurality of first ripper members such as ripper members 16 and 16'. Another first ripper member (not shown) would be paired in tandem with second ripper member 18'' in the plurality arrangement shown. It should also be noted that the plurality of ripper members depicted in FIG. 1 illustrates one variation of this tandem ripper assembly. What is important is the placement of first ripper member 16 in front of second ripper member 18 in a tandem fashion as depicted in FIGS. 2 and 3. The additional second ripper members such as 18' and 18'' along with additional first ripper members may be added as desired.

Operation of the tandem ripper assembly envisions lowering the assembly 10 into the terrain by extension of hydraulic cylinder 44 or by use of a similar extension means. First ripper member 16 will enter the terrain as indicated in FIG. 3 and in the phantom portion of FIG. 4. As first ripper member 16 enters a terrain a channel or tunnel will be ripped in the earth to the depth first ripper 16 is extended. It should be noted that at least some of the loosened earth will be thrown out of the channel or tunnel while the remainder will fall back in the trench. Continued extension of hydraulic cylinder 44 results in second ripper member 18 following first ripper member 16 into the ground. Initially second ripper member 18 serves no useful purpose as first ripper member 16 extends into the terrain for a greater depth. However, as hydraulic cylinder 44 is extended to its full extent second ripper member 18 goes deeper into the terrain, as indicated in FIG. 4 (see also FIG. 2).

At this point the force required to pull tandem ripper assembly 10 through the earth will be approximately twice the force required for a single ripper member operating at one half the depth. As previously noted, should a single ripper member extend into the terrain at the depth of the second ripper member shown in FIG. 4 and should there be no second ripper member, the force required would be approximately four times that required for the single ripper member when positioned at one half the depth.

During operation it may be necessary to change the cant or tilt of the ripper members. Accordingly, second hydraulic cylinder 48 may be extended or retracted, as the case may be, to properly position the ripper members relative to the terrain. As indicated in FIG. 3, it may be more appropriate to have first ripper member 16 enter the terrain in a vertical orientation rather than in a tilted orientation. Accordingly, second hydraulic cylinder 48 may be extended to rotate the first and second ripper members about pivot pin 36. This rotation about pivot pin 36 can also serve a secondary purpose should the ripper members become clogged with excessive earth. Such rotation has been found to clear the earth from between the teeth because of the relative movement therebetween.

Referring again to FIG. 1, each individual lower member 56 and 60 may be moved upwardly and downwardly in the appropriate upper portion 54 or 58 of ripper members 18 and 16, respectively, or lower members of differing lengths may be used. This may change the relative positioning of the ripper members from the various positions shown in the other illustrations; however, the operation of the linkage remains the same so that movement of the first member is relatively less than movement of the second member upon actuation of hydraulic cylinder 44. Normally, lower member 56 of second ripper member 18 will be longer than lower member 60. Thus, ripper member 18 will cut deeper than ripper member 16 with the ripper assembly 10 in its fully extended state.

It should be noted that in the arrangement shown in FIG. 1, second ripper member 18' has a shorter upper section 54' that is affixed to a transverse beam 62. A similar beam 64 may interconnect the plurality of first ripper members 16 and 16'. In this arrangement there are paired link assemblies operating on the outer ripper members with the motion imparted thereto by the hydraulic cylinders transmitted to the center tandem ripper members 16' and 18' by beams 62 and 64. It may be appropriate to only use the center ripper members 16' and 18′ as indicated in FIG. 1. It should be understood that the tandem ripper assembly may also consist of only one pair of ripper members as shown in FIGS. 2 and 3.

Other aspects, objects and advantages of this invention can be obtained from a study of the drawings, the disclosure, and the appended claims.

I claim:

1. A ripper assembly comprising
a first ripper member (16),
a second ripper member (18),
connection means (20,22,24) for interconnecting said first (16) and second (18) ripper members for sequentially (1) lowering said first ripper member (6) to a vertical position below said second ripper member (18), and (2) lowering said second ripper member (18) to a vertical position below said first ripper member (16),
actuating means (44) for moving said connection means generally vertically, and
tilt means (48) for tilting the second ripper member (18) relative to the connection means (20,22,24) and further wherein said connection means (20,22,24) is responsive to said tilt means (48) for imparting substantially the same tilt to the first ripper member (16).

2. The ripper assembly of claim 1 wherein the connection means (20,22,24) comprises link means (22,24) for connecting said first ripper member (16) to a vehicle and linkage means (20) for pivotally connecting said first (16) and said second ripper members (18).

3. The ripper assembly of claim 2 wherein the actuating means (44) for moving said linkage means comprises a first hydraulic cylinder affixed at one end to a vehicle (14) and at the other end to said linkage means (20).

4. The ripper assembly of claim 3 wherein the link means (22,24) for connecting the first ripper member (16) and a vehicle (14) comprises a first link (22) pivotally affixed at its one end (42) to said vehicle and at its other end to said first ripper member (16) by a first pivot (36) and a second link (24) pivotally affixed at its one end (13) to said vehicle (14) and pivotally affixed at its other end (26) to the linkage assembly (20).

5. A ripper assembly of claim 4 wherein the linkage assembly (20) comprises a lever (30) pivotally affixed to the first ripper member (16) by the first pivot (36), said lever (30) pivotally affixed to the second ripper member (18) by a second pivot (38), the second link (24) affixed to said lever (30) by a third pivot (26), said third pivot (26) positioned at the end of said lever (30) distal of said second pivot (38), said first pivot (36) intermediate said second (38) and third (26) pivots.

6. The ripper assembly of claim 3 or claim 5 further comprising means (48) for tilting said second ripper member (18).

7. The ripper assembly of claim 5 wherein the linkage assembly (20) further comprises a third link (28) pivotally connecting said first (16) and said second (18) ripper members.

8. A ripper assembly comprising:
a first ripper member (16);
a second ripper member (18) disposed in tandem relationship relative to said firt ripper member;
link means (22,24) for connecting said first ripper member (16) to a vehicle (14);
linkage means (20) for pivotally connecting said first (16) and said second ripper members (18) together;
means (44) for moving said linkage means generally vertically;
tilt means (48) for tilting said second ripper member (18);
said linkage means (20) connecting said first (16) and said second (18) ripper members responsive to said tilt means for imparting substantially the same tilt to the first ripper member (16);
said link means (22,24) for connecting said first ripper member (16) to a vehicle (14) cooperating with said linkage means (20) upon vertical movement of said linkage means (20) for imparting a greater movement to said second ripper member (18) than said first ripper member (16).

* * * * *